United States Patent [19]

Dickey

[11] 4,139,005

[45] Feb. 13, 1979

[54] SAFETY RELEASE PIPE CAP

[76] Inventor: Gilbert C. Dickey, 23185 Woodville Rd., Genoa, Ohio 43430

[21] Appl. No.: 829,919

[22] Filed: Sep. 1, 1977

[51] Int. Cl.[2] ..... F16L 55/10

[52] U.S. Cl. ..... 138/89; 138/96 R; 138/96 T; 220/89 B; 137/74

[58] Field of Search ..... 138/89, 96 R, 96 T; 220/DIG. 16, DIG. 17, DIG. 27, 89 A, 89 B; 137/72, 74, 77

[56] References Cited

U.S. PATENT DOCUMENTS

| | | | |
|---|---|---|---|
| 571,476 | 11/1896 | Hayden | 220/89 A |
| 589,944 | 9/1897 | Greengrass | 220/89 A |
| 1,692,710 | 11/1928 | Spahn | 138/96 T X |
| 2,095,528 | 10/1937 | Osborn et al. | 138/96 T |
| 2,134,730 | 11/1938 | Osborn | 138/96 T |
| 2,370,870 | 3/1945 | McKeague | 220/89 A |
| 2,453,891 | 11/1948 | Burt | 220/89 A |
| 2,580,426 | 1/1952 | Heigis | 220/89 A X |
| 2,726,002 | 12/1955 | Dalianis | 220/89 A X |
| 2,766,408 | 10/1956 | Georgiev et al. | 220/89 B X |
| 3,669,302 | 6/1972 | Markarian | 220/89 B X |
| 3,767,079 | 10/1973 | Jones | 220/89 A |
| 3,815,534 | 6/1974 | Kneusel | 220/89 A X |
| 3,834,580 | 9/1974 | Ludwig et al. | 220/89 A |
| 3,854,522 | 12/1974 | Didyez et al. | 220/89 A X |
| 3,895,466 | 7/1975 | Melton | 138/89 X |
| 3,906,976 | 9/1975 | Nohr et al. | 220/89 B X |

*Primary Examiner*—Richard E. Aegerter
*Assistant Examiner*—James E. Bryant, III
*Attorney, Agent, or Firm*—David H. Wilson

[57] ABSTRACT

A safety release pipe cap for emergency venting of fluids under excessive temperatures by melting out a replaceable portion. In one embodiment the replaceable portion is arranged to yield under excessive pressure differentials on its opposed faces. The cap is employed on tanks. A threaded ferrule is provided with a flange overlying the end of a pipe with which it is threadingly engaged to clamp the periphery of a separable disk of thermally fusible material against the pipe end. When the disk is of a yieldable plastic it functions as a seal gasket on the pipe end and will yield under pressure differentials to provide a visual indication of such differentials by material and wall thickness characteristics as well as the geometry of the disk. Temperature fusing can be controlled by these characteristics and particularly the melting temperature of the plastic.

8 Claims, 5 Drawing Figures

SAFETY RELEASE PIPE CAP

BACKGROUND OF THE INVENTION

1. Field of the Invention

The present invention relates to safety closures for containers and more particularly to closures which release under adverse conditions to vent the containers. Such release can be under conditions of excessive temperature in which a portion of the cap is melted to open the normally closed aperture to the container interior. In certain constructions the buildup of internal pressures is effective to open the vent passage or to distort the cap as an indication of the buildup.

2. Description of the Prior Art

Traditionally, storage tanks and the like have been fitted with a pipe on their upper surface which was sealed with a fusible metal cap. These caps made of metal were almost exclusively of brass, aluminum or malleable stainless. These caps were constructed in such a fashion as to breach a seal system by melting out a fusible link which sealingly retained a metal closure for the aperture in a metal ferrule upon the attainment of a certain predetermined temperature of the vessel in which the material is stored, and thus vent the warm high pressure volatile internal material to the ambient external atmosphere. This method circumvented the possibly explosive buildup of internal vapor pressure of these volatile and usually flammable materials.

These metal cap safety devices presented a number of major practical disadvantages. First, should one of these metal caps be dropped inadvertently, there was a high probability that the impact would so deform the threaded areas that the cap would be functionally useless. Second, the extreme mass of such caps, up to six times the mass of the hereinafter described device, caused great inconvenience in transport with a working vehicle such as a tractor trailer rig. Third, these caps are often used in an environment rich in the vapors of the transported material as well as being exposed to all-weather conditions. This combination of corrosive forces often caused a substantial corrosion of the threads of the cap and its subsequent fusion or "locking" on the threads of the metal fitting of the storage unit. This caused major expense in the forced removal of the cap and the subsequent damage to the threads of the storage unit emergency vent pipe, which was permanently anchored to the storage unit. Fourth, the metal fittings generally had to be lubricated to facilitate easy operation of the cap threads on the pipe threads. In a normal use such lubricants as greases and oils are of no concern but in vessels containing highly purified chemicals these oils and greases may infiltrate the material being transported and substantially damage the quality and usefulness of the material. Individually, these problems are of import but when combined they form a substantial detriment to the safe economical use of these metal caps.

Also, if a metal cap does maintain its functional integrity there are two further problems present. First, petro chemical transport and storage units are periodically cleaned on their interior surfaces with high pressure steam. The fusible caps are usually removed from the tank pipe and placed on the adjacent tank surface. As the steam cleans the interior of the tank it heats the tank. This elevation in temperature is transmitted from the tank surface to the cap fusing mechanism by the metallic body of the metal cap, which has a high thermal conductivity. Frequently the fuses are triggered in this fashion rendering them useless. These fuses must be shipped back to the factory for refusing which is not only time consuming, but also fairly expensive, when compared to the purchase price of an entire new fuse cap.

An object of the present invention is to improve sealable safety vent release caps.

Another object is to enable release caps to be reconstructed simply in the field.

A third object is to eliminate the need for seal gaskets for safety release caps.

A fourth object is to avoid accidental fusing of the fusible elements of safety release caps.

A further object is to combine thermally fusible venting with pressure sensitive venting in a replaceable cap.

SUMMARY OF THE INVENTION

The above objectives of the invention may typically be achieved by a fusible pipe cap system formed of polymers to be used in the control of pressure in a volatile material storage unit and in association with the emergency vent system of said storage unit comprising a cap device having a threaded ferrule and a separable fuse insert to be fitted into the ferrule which can be replaced on site without the return to the factory of the entire unit. The fuse insert may be in the form of a disk of various polymeric materials, geometries and wall thicknesses to melt out of the ferrule at a desired venting temperature and/or distort at a desired venting pressure differential.

BRIEF DESCRIPTION OF THE DRAWINGS

The objects and advantages of the invention will become more apparent from the following detailed description of an embodiment of the invention when considered in light of the accompanying drawings, in which.

DESCRIPTION OF THE PREFERRED EMBODIMENT(S)

Figure 1:
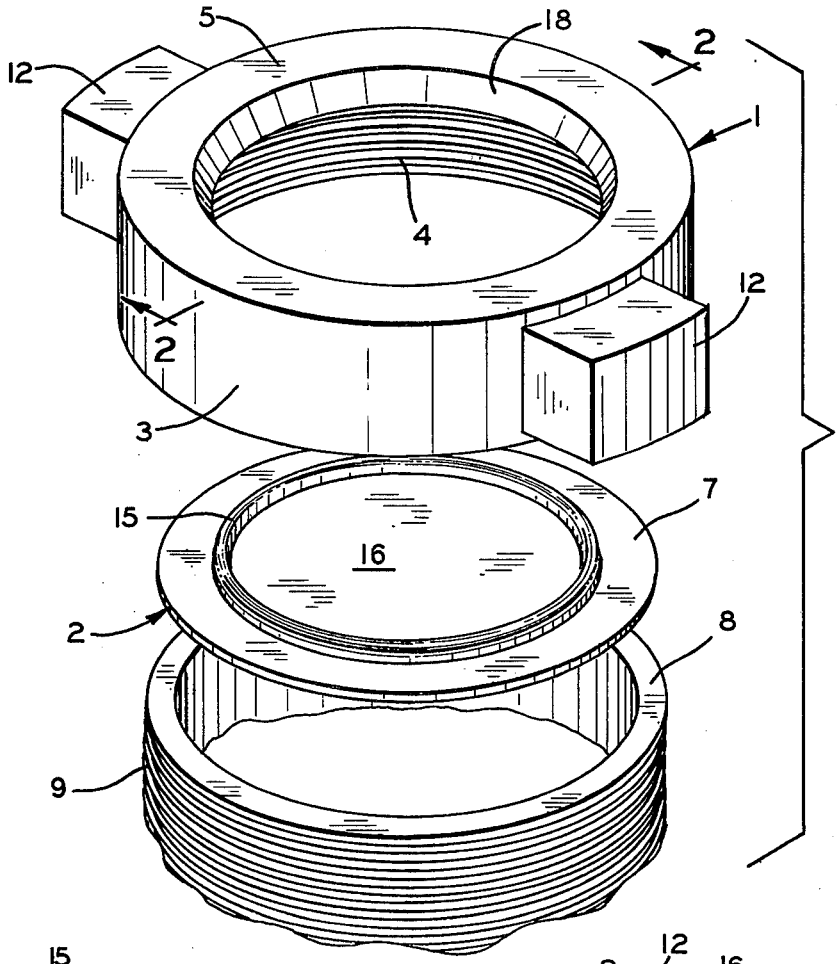
FIG. 1 is an exploded perspective view of a fusible cap system adapted to be threadingly attached to a vent pipe, fragmentarily shown, of a storage vessel incorporating the features of the invention.
Figure 2:
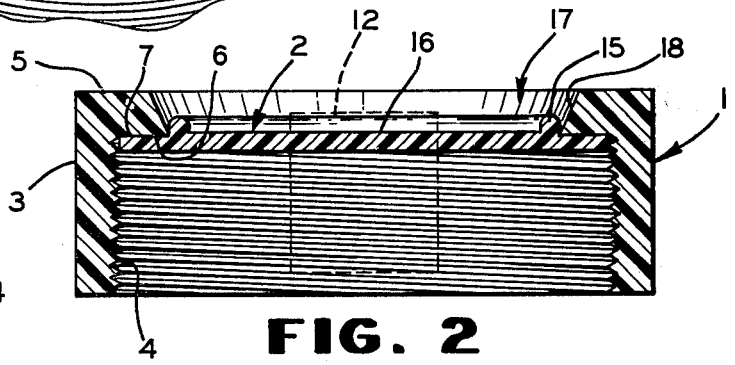
FIG. 2 is a sectional view along the line 2—2 of the ferrule of FIG. 1 showing the assembled ferrule and fusible closure or disk.

Referring to the drawings wherein like reference numerals designate similar parts throughout, there is illustrated a two part fusible cap device to regulate the maximum pressure level in a storage unit for volatile materials. As seen in FIGS. 1 and 2 the invention consists of a ferrule 1 with an individually separable insert 2 which is composed of a mixed polymeric material typically consisting of a 80/20 percent by weight mixture of low density polyethylene and ethylvinylacetate, respectively. However, any suitable polymer mix or native copolymer may be used if such composition provides the necessary thermal and materials strength properties. The fuse insert or fusing disk composed of the 80/20 mixture above will have an average melting out temperature of 220° F., but in no case will the melting out temperature exceed 250° F. The ferrule 1 is composed of the material polypropylene and is individually separable from the fuse insert 2, and maintained therein by frictional engagement of its outer edge with the minor diameter of internal threads 4. The polypropylene ferrule is mechanically and thermally stable to substantially higher temperatures than disk 2.

Typically ferrule 1 has cylindrical sidewalls 3 internally threaded to accommodate a standard pipe thread as at 4. An internal flange 5 provides on its inner face 6 one seat for the peripherial face 7 of a fusible disk 2 so that the periphery 7 is clamped between the face 6 and the end 8 of a vent pipe 9 upstanding from a closed container 11 as at its top. Application and removal of the ferrule 1 and thus the cap assembly is facilitated by radially extending lugs 12 which provide a suitable purchase to turn the threaded ferrule on and off the threaded vent pipe. In one embodiment a three inch fusible vent cap has a polypropylene ferrule having an outside diameter of three and seven eights inches, a internal depth of about one inch, a flange thickness of about one quarter inch and a flange face width of about three eights of an inch.

Fusible disk 2 is arranged with an upstanding bead 15 which fits within the inner diameter limits of flange 5. The periphery 7 of the disk outside bead 15 is the portion which tends to yield either by melting in response to an elevated temperature or a combination of melting and distorting in response to a combination of temperature and pressure within the closed vessel 11. In the exemplary three inch fusible vent cap intended to rupture at 225° F., the peripheral wall of the disk of 80/20 low density polyethylene and ethylvinylacetate is about one tenth of an inch thick and has an outer diameter which frictionally fits within the ferrule 1 and is retained therein by friction. Such disks are sufficiently flexible to be introduced and removed from within the ferrule with finger pressure. Their wall thickness of the central portion 16, that inside the stiffening bead 15, is about one eighth inch.

In practice a ferrule 1 and disk 2 require no gasketing to the vent pipe since the resilience and flexibility of the disk material enables it to be compressed as a gasket between face 6 of the ferrule internal flange 5 and the end 8 of the vent pipe 9. This enables the metal of the vent pipe to conduct heat in the container structure or its contents directly to the thinner walled portion of the fusible element, disk 2, in the region designed to melt out as the releasing mechanism. The melting of the periphery 7 can be augmented where the temperature is increased slowly in the vicinity of the melting temperature of the material of disk 2 by the softening of that material to enable the buildup of pressure within the vessel to cause the periphery to flow as the center portion baloons. (See FIG. 5) Thus, the periphery, even though clamped between its seats, innerface 6 and pipe end 8, will be withdrawn from between those seats when softened by elevated temperatures and subjected to the forces of the internal pressure. When the periphery is withdrawn the seal is ruptured and the container is vented.

Figure 3:
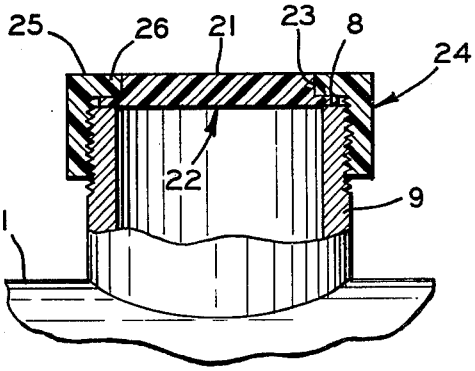
FIG. 3 is a fragmentary sectioned view of another form of the invention secured to a threaded pipe as seen in the field.

In some applications it is advantageous to avoid the cavity 17 within the center of the ferrule above the disk since that cavity tends to accumulate dirt and other debris and, in winter, ice and snow. Such accumulations can obscure the disk, can impede the pressure distortion of the disk center 16 and, if material works into the space between the disk and face 6, may impair the seal of the cap. The construction shown in FIG. 3 mitigates against this accumulation of foreign matter by an extension of the center portion 21 of the fusible disk 22 through the open center 23 of the ferrule 24 to a location at least level with the outer face 25 of the ferrule flange 26. In this embodiment no chamfer as at 18 of FIG. 2 is provided on the ferrule flange inner diameter so that space between the ferrule and the disk center portion is minimized to avoid accumulations between those elements.

Figure 4:
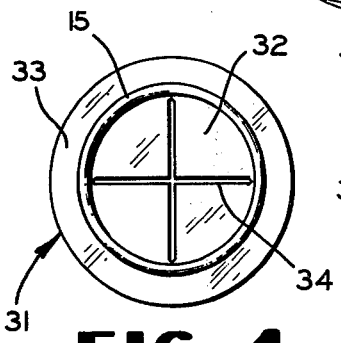
FIG. 4 is an alternative embodiment of the invention wherein the fuse insert is arranged to vent excessive pressure in the container to which it is applied.
Figure 5:
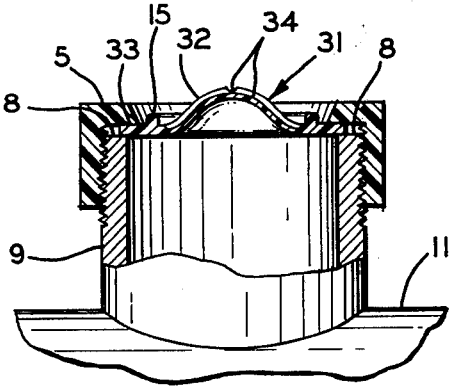
FIG. 5 illustrates in fragmentary section a typical use of the device of FIG. 4 in conjunction with a storage tank for volatile materials having a pressure buildup.

The embodiment of FIGS. 4 and 5 illustrate another aspect of the fusible pipe cap assembly wherein the disk is also arranged as a pressure responsive fuse. A disk 31 having a center wall portion 32 of a thickness of the same general magnitude as its peripherial portion 33 is shown with a weakening cross score 34 in FIG. 4. That disk may be of either the generally planar form of FIGS. 1 and 2 or of the top hat form of FIG. 3 where the center portion is maintained with a thin wall by having its internal contours follow the external contours (not shown). In the exemplary disk size, material, and thickness described with respect to FIGS. 1 and 2, the crossed score lines 34 on the outer face of disk 31 extending about two inches across the diameter of the central wall portion 16 of about two and one quarter inch diameter inside bead 15, when one sixteenth inch deep in a one eighth inch thick wall, will blow out by tearing along the scores at a pressure differential of from ten to fifteen pounds per square inch. It is to be appreciated that the venting pressure can be adjusted from the seventy pounds per square inch of an unscored disk of FIGS. 1 and 2 downward to less than that illustrated by choice of the length and form of the score line or lines, the disk thickness, and the score line depth.

The effect of a pressure buildup within the container 11 is illustrated in FIG. 5. The center portion 32 of the disk 31 baloons outward prior to either pulling the peripheried flange 33 free of the clamping flange 5 and vent pipe end 8 or to rupturing the center, thereby providing a preliminary visual indication of the buildup prior to pressure relief. As can be seen at the score line 34, the disk 31 is weakened and tends to rupture along the line 34 when under pressure.

The above described fusible cap system is particularly effective for fusing over-the-road tankers in accordance with ICC regulations. It does not become bonded in place by corrosion since the polypropylene of the ferrule is relatively inert. The high temperatures of steam cleaning do not adversely affect the thermally fusible disk when the cap assembly is placed on the tank since the polypropylene of the ferrule does not conduct sufficient heat to the disk to raise it to its melting temperature. The assembly is resistant to damage by impact. Since the disks are inexpensive, thin and lightweight, spare disks are carried conveniently and can be replaced manually. Therefore, there is less tendency to substitute non fusible caps on the vent pipes of truck tanks.

Fusible cap assemblies according to this invention have been used on storage tanks and even drums. In the case of storage vessels subjected to high temperatures such as imposed by tropical sun the vent caps have been employed to avoid imposing destructive pressures on the vessels.

It is to be appreciated that fusible cap assemblies of different materials, dimensions and geometries can be employed without departing from the spirit and scope of this invention. While threaded couplings have been shown, alternative forms of securing means for the cap assembly are contemplated.

What is claimed is:

1. A thermal safety release pipe cap assembly which opens at a predetermined temperature comprising a ferrule of relatively low thermal conductivity material having a melting temperature above said predetermined temperature adapted to be fitted over the end of a pipe of relatively high thermal conductivity, said ferrule having an open portion coincident with the interior of the pipe and an interior wall embracing the pipe end; a closure element for said open portion of said ferrule frictionally maintained within said ferrule, said element being of a material which melts at said predetermined temperature to expose the open portion of said ferrule to the pipe interior; and means for sealing securing said assembly to the pipe comprising an inwardly extending flange on said ferrule which overlays the end of the pipe and a peripheral wall of uniform thickness on said closure element having outer perimeter elements frictionally engaging the interior wall of said ferrule, said ferrule, when securred to the pipe, pressing said flange upon said peripheral wall to clamp said peripheral wall in intimate heat transfer relationship to the pipe between said flange and the end of the pipe.

2. The combination according to claim 1 wherein said closure element has a wall which is thin and flexible relative to the thickness of the wall of said ferrule adjacent said open portion, said wall of said closure element being adapted to be displaced in said open portion when subjected to pressure differential on its opposite faces.

3. The combination according to claim 2 wherein said closure element wall is weakened in localized regions to facilitate the rupture of said wall in said regions when subjected to a pressure differential on its opposite faces.

4. The combination according to claim 1 wherein said ferrule and said closure are composed of polymeric materials.

5. The combination according to claim 1 wherein said ferrule is composed of polypropylene and said closure is a mixture of low density polyethylene and ethylvinylacetate.

6. The combination according to claim 1 wherein said closure is a disk of a mixture of low density polyethylene and ethylvinylacetate.

7. The combination according to claim 6 wherein said disk is adapted to melt out of said open portion below 250° F. and is a mixture of about 80 weight percent low density polyethylene and about 20 weight percent ethylvinylacetate.

8. The combination according to claim 1 wherein said flange on said ferrule bounding said open portion has a uniform thickness adjacent said open portion, said open portion is circular and concentric with said ferrule, and wherein said closure includes a right circular cylindrical portion of at least the height of the thickness of said flange adjacent said open portion and of a diameter closely fitting said open portion throughout the thickness of said flange adapted to be fitted within said open portion.

* * * * *